US012116762B2

(12) United States Patent
Hoffman

(10) Patent No.: US 12,116,762 B2
(45) Date of Patent: Oct. 15, 2024

(54) DISPOSABLE COVER FOR ACCORDION PLUNGERS

(71) Applicant: Maurice M. Hoffman, Northridge, CA (US)

(72) Inventor: Maurice M. Hoffman, Northridge, CA (US)

( * ) Notice: Subject to any disclaimer, the term of this patent is extended or adjusted under 35 U.S.C. 154(b) by 126 days.

(21) Appl. No.: 18/151,133

(22) Filed: Jan. 6, 2023

(65) Prior Publication Data

US 2024/0229438 A1 Jul. 11, 2024

(51) Int. Cl.
*E03C 1/308* (2006.01)

(52) U.S. Cl.
CPC ..... *E03C 1/308* (2013.01); *E03C 2201/00* (2013.01)

(58) Field of Classification Search
CPC ..... E03C 1/308; E03C 1/304; E03C 1/30
USPC ..... 4/255.11
See application file for complete search history.

(56) References Cited

U.S. PATENT DOCUMENTS

| | | | | |
|---|---|---|---|---|
| 7,124,450 | B2 * | 10/2006 | Davidson | E03D 9/00 150/161 |
| 10,053,846 | B1 * | 8/2018 | Rim | E03D 11/00 |
| 10,413,139 | B2 * | 9/2019 | Singer | A47K 17/00 |
| 2009/0049593 | A1 * | 2/2009 | Hodkiewicz | E03D 9/00 4/255.05 |
| 2019/0119892 | A1 * | 4/2019 | Patterson | E03C 1/308 |
| 2021/0277642 | A1 * | 9/2021 | Shapiro | A47K 17/00 |

* cited by examiner

*Primary Examiner* — Huyen D Le
(74) *Attorney, Agent, or Firm* — PARSONS & GOLTRY; Robert A. Parsons; Michael W. Goltry

(57) ABSTRACT

An accordion toilet plunger with disposable cover assembly includes an elongated handle and an attached accordion head having an open end defined by a circular rim opposite the elongated handle. A plurality of pleats is formed between the elongated handle and the open end, defining an interior volume. A flexible plastic bag having closed end and an open end is provided. The bag has an interior volume enclosing the accordion head and at least a portion of the elongated handle. A portion of the closed end of the flexible plastic bag is received within the interior volume of the accordion head. A securing ring is moveable between an expanded condition and a contracted condition to expand around and contract against the circular rim and secure the flexible plastic bag to the circular rim.

8 Claims, 4 Drawing Sheets

DISPOSABLE COVER FOR ACCORDION PLUNGERS

FILED OF THE INVENTION

This invention relates to accordion style toilet plungers and more specifically to disposable covers for reducing cleaning efforts.

BACKGROUND OF THE INVENTION

Toilet plungers are used in conjunction with toilets to remove clogs that prevent toilets from operating properly. It is understood that such plungers may also be used to unclog sinks and the like, all of which are intended to be included in this disclosure and to come within the concept of a clogged toilet. In particular, accordion style plungers are very effective at removing clogged toilets and drains. The standard rubber-cup plungers are prone to buckling, and they do not create a good vacuum seal around the toilet drain that you need to unclog the toilet. Also, the rubber cup tends to turn inside out and requires repositioning which can cause splashing of toilet water. An accordion plunger has a much larger plunger head volume to create a greater vacuum. As is known by anyone with a flushable toilet, clogs occur that prevent water and waste, such as feces, from flowing down the connecting disposal pipes. Generally, the flexible head of the accordion plunger is placed in the toilet over the outlet in the bottom. The plunger is forcibly moved down and released, creating increased pressure in the outlet which loosens the clog allowing the free flow of the waste material through the outlet.

As is immediately obvious, this procedure results in an unsanitary plunger which must then be rinsed off or sanitized to remove all waste from the surfaces of the flexible head and lower portion of the handle. The pleats on the inside and outside of an accordion plunger are particularly problematic in catching and retaining undesirable materials in a clogged toilet. This washing or sanitizing process can be very challenging and can then result in an unsanitary sink or other structure in which the plunger is washed.

It would be highly advantageous, therefore, to remedy the foregoing and other deficiencies inherent in the prior art.

Accordingly, it is an object of the present invention to provide a new and improved disposable cover for accordion toilet plungers.

It is another object of the present invention to provide a new and improved disposable cover for toilet plungers that improves the operation and effectiveness of toilet plungers and reduces the effort required for cleaning the accordion plunger after use.

It is another object of the present invention to provide a new and improved disposable cover for accordion toilet plungers that is easy to use and inexpensive.

SUMMARY OF THE INVENTION

Briefly to achieve the desired objects and advantages of the instant invention in accordance with a preferred embodiment provided is a disposable accordion toilet plunger cover assembly designed to be used with an accordion toilet plunger. The accordion toilet plunger has an elongated handle and an accordion head attached to one end of the handle, the accordion head having an open end defined by a circular rim opposite the elongated handle and a plurality of pleats formed between the elongated handle and the open end, the plurality of pleats defining an interior volume. The cover assembly includes a flexible plastic bag having an inner surface and an outer surface formed into a closed end and an open end, the bag having an interior volume sufficient to enclose the accordion head and at least a portion of the elongated handle. A securing ring, is moveable between an expanded condition and a contracted condition to expand around and contract against the circular rim and secure the flexible plastic bag to the circular rim.

Also provided is a method of using a disposable toilet plunger cover assembly with an accordion toilet plunger. The method includes the steps of providing an elongated handle and an accordion head attached to one end of the handle. The accordion head having an open end defined by a circular rim opposite the elongated handle and a plurality of pleats formed between the elongated handle and the open end, the plurality of pleats defining an interior volume. Also provided is a flexible plastic bag having an inner surface and an outer surface formed into a closed end and an open end, the bag having an interior volume, and a securing ring moveable between an expanded condition and a contracted condition. A portion of the closed end of the flexible plastic bag is positioned through the circular rim into the interior volume of the accordion head. The open end of the flexible plastic bag is extended over the circular rim to enclose the accordion head and at least a portion of the elongated handle. The securing ring is coupled to the circular rim with the flexible plastic bag captured therebetween.

BRIEF DESCRIPTION OF THE DRAWINGS

Specific objects and advantages of the invention will become readily apparent to those skilled in the art from the following detailed description of a preferred embodiment thereof, taken in conjunction with the drawings in which.

DETAILED DESCRIPTION

Figure 1:
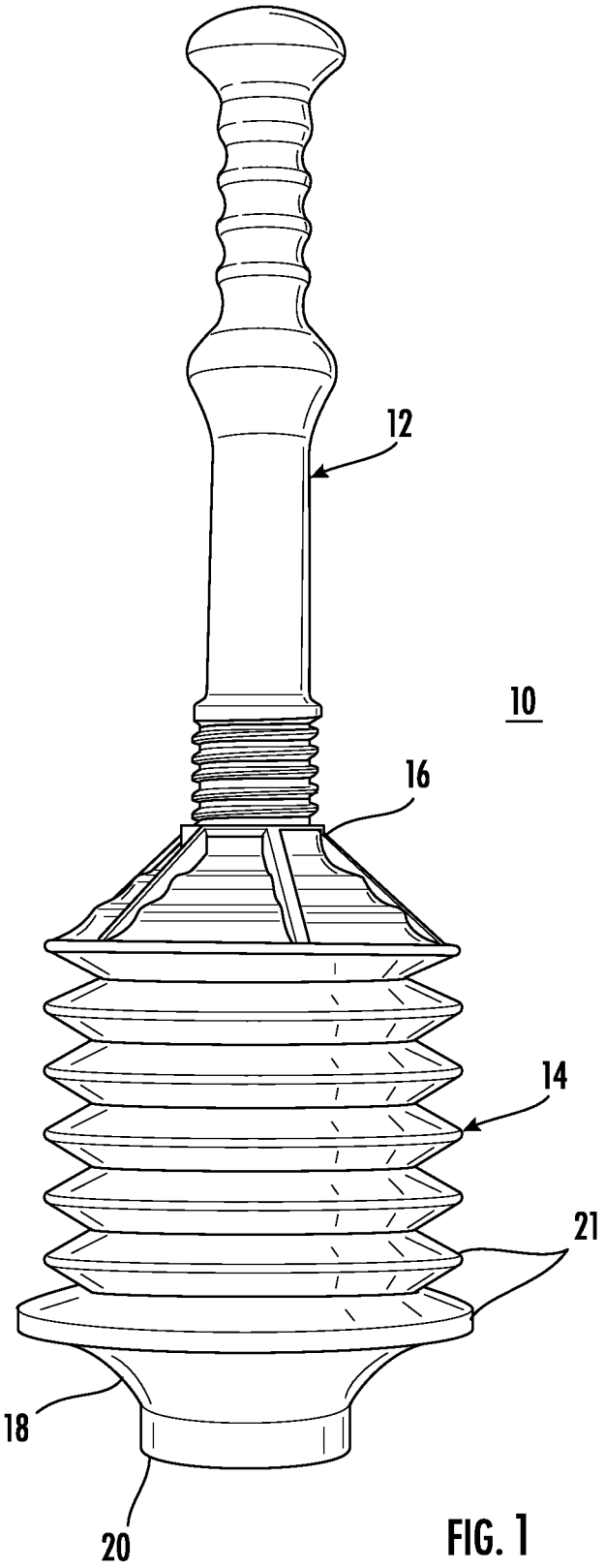
FIG. 1 is a front view of an accordion toilet plunger.

Turning now to the drawings in which like reference characters indicate corresponding elements throughout the several views, attention is directed to FIG. 1, illustrating an accordion toilet plunger generally designated 10. Accordion toilet plunger 10 includes an elongated handle 12 attached to an accordion head 14. Accordion head 14 is attached to elongated handle 12 at end 16 and terminates in an open end 18 defined by a circular rim 20 opposite elongated handle 12. Accordion head 14 includes a plurality of pleats 21 formed between end 16 and open end 18, defining an interior volume 22 (FIG. 3) accessed through circular rim 20 and open end 18. As is well-known in the art, accordion head 14 is generally formed of rubber, plastic or other stiff but flexible material. Circular rim 20 is designed to be pressed against and form a seal with the inner surface of a toilet bowl around the exit pipe. Compression and release of accordion head 14 generates pressure and vacuum, respectively, within the exit pipe to remove blockages.

Figure 2:
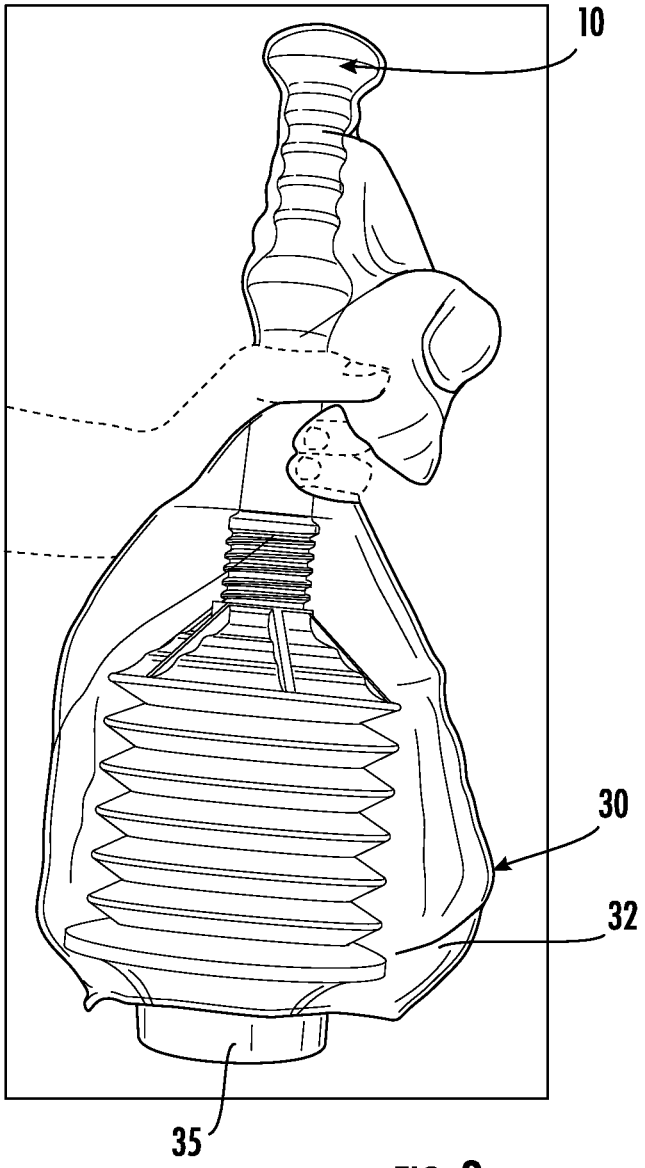
FIG. 2 is a front view of the accordion toilet plunger with disposable cover according to the present invention.
Figure 3:
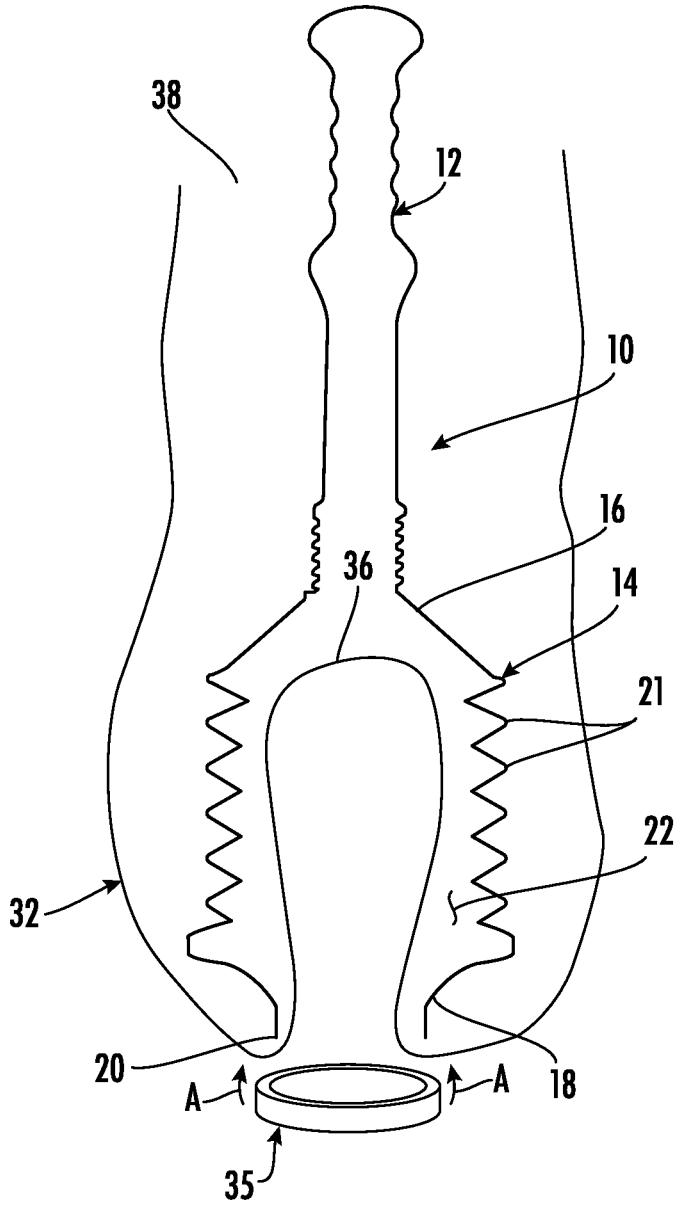
FIG. 3 is a schematic view of the accordion toilet plunger with disposable cover.

Referring now to FIGS. 2 and 3, accordion toilet plunger 10 is illustrated with a disposable toilet plunger cover generally designated 30, according to the present invention.

Disposable toilet plunger cover 30 includes a flexible plastic bag 32 and a securing ring 35. With additional reference to FIG. 3, flexible plastic bag 32 has an inner surface and an outer surface, a closed end 36 and an open end 38. Flexible plastic bag 32 has an interior volume sufficient to enclose accordion head 14 of standard accordion toilet plunger 10 and at least a portion of elongated handle 12. Securing ring 35 is employed to attached closed end 36 of flexible plastic bag 32 to circular rim 20 as will be described presently. Flexible plastic bag 32 is illustrated as a thin, plastic material that is preferably clear or transparent to simplify the operation of the plunger and cover. The material could be, for example, similar in thickness to flexible material used commercially for temporarily enclosing food. It should be understood, however, that clear or transparent is not necessary. Other thin, flexible plastics, such as commercially available leaf and garbage bags, may be used if desired or less expensive.

Referring specifically to FIG. 3, when adapting accordion toilet plunger 10 for use using disposable toilet plunger cover 30, closed end 36 of flexible plastic bag 32 is positioned through circular rim 20 and deep into interior volume 22. The remaining portions of flexible plastic bag 32 is wrapped upwardly over circular rim 20, the outside of accordion head 14 and further upwardly to cover at least a portion of, if not all of, elongated handle 12. Securing ring 35 is snapped over circular rim 20 in the direction of arrowed lines A, capturing flexible plastic bag 32 between circular rim 20 and securing ring 35. In this manner securing ring 35 holds flexible plastic bag 32 securely in position around accordion toilet plunger 10 and within interior volume 22. By inserting flexible plastic bag 32 within interior volume 22, use of accordion toilet plunger 10 is not adversely impacted since the interior volume is substantially entirely used. It will be understood that the volume defined by the portion of flexible plastic bag 32 inserted into interior volume 22 is similar to the volume of interior volume 22, and will compress with the compression of plurality of pleats 21 to operate in the same manner as an uncovered accordion toilet plunger.

Figure 4:
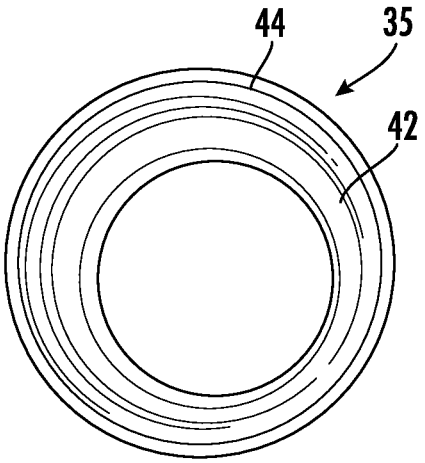
FIG. 4 is a top view of a securing ring according to the present invention.
Figure 5:
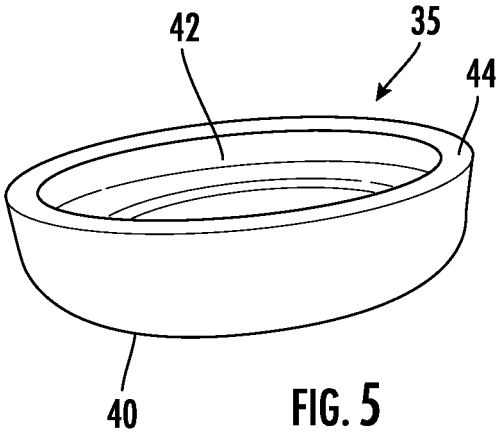
FIG. 5 is a perspective side view of the securing ring of FIG. 4.

With reference to FIGS. 4 and 5, securing ring 35 is formed of rubber that has a soft enough texture to form a reasonable seal between the bottom surfaces of accordion toilet plunger 10 and the surface of a toilet. The material of securing ring 35 is also elastic in character to allow it to be expanded to fit around circular rim 20 and allowed to contract tightly there against. Thus, securing ring 35 is moveable between an expanded condition and a contracted condition. Slightly different sizes of circular rim 20 can be accommodated due to the elastic nature of securing ring 35. Securing ring 35 includes a sealing surface 40 for engaging a toilet drain, an opposing inner shoulder 42 for receiving circular rim 20 thereagainst, and an upright element 44 to expand around, and contract against circular rim 20.

The operation or method of use of accordion toilet plunger 10 and disposable cover 30 is as follows. Accordion Toilet plunger 10 is inserted inside of flexible plastic bag 32. Closed end 36 is then pushed into interior volume 22 of plunger head 14. Securing ring 35 is pressed against bag 32 at circular rim 20, moved to the expanded condition to slip over circular rim 20 and allowed to contract to the contracted condition to grip circular rim 20 firmly holding bag 32 in position. A single layer of bag 32 will be sandwiched between securing ring 35 and circular rim 20 of plunger head 14. In use, a seal will be formed between sealing surface 40 of securing ring 35 and the surface of a toilet being operated on. The upper end of bag 32 is then bunched around elongated handle 12.

Accordion toilet plunger 20 is now ready for use in clearing obstructions from a toilet. Once the obstruction is cleared and the toilet is again operating properly, bag 32 is turned inside out as it is removed from plunger 10. Securing ring 35 pops off circular rim 20 inside bag 32 and bag 32 and securing ring 35 can be disposed of. Thus, the messy and unsanitary outer surface of bag 32 is now completely contained within bag 32 and the inner surface, which is completely clean, now encloses the prior outer surface and can be simply disposed of in the garbage. Plunger 10 is clean, since it never came in contact with any of the fluids in the toilet, and can simply be placed back in its normal storage location.

Thus, a new and improved disposable cover for accordion toilet plungers is disclosed. Also, a new and improved method of using the disposable cover for accordion toilet plungers is disclosed. The new and improved disposable cover for accordion toilet plungers does not reduce the operation or effectiveness of accordion toilet plungers and greatly reduces the effort required for cleaning the accordion toilet plunger after use. Sealing surface 40 of securing ring 35 actually improves the formation of a seal with the toilet, increasing the effectiveness of accordion plunger 10. Further, the new and improved disposable cover for accordion toilet plungers is easier to use and relatively inexpensive.

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

The invention claimed is:

1. A disposable accordion toilet plunger cover assembly designed to be used with an accordion toilet plunger, the accordion toilet plunger having an elongated handle and an accordion head attached to one end of the handle, the accordion head having an open end defined by a circular rim opposite the elongated handle and a plurality of pleats formed between the elongated handle and the open end, the plurality of pleats defining an interior volume, the cover assembly comprising:

a flexible plastic bag having an inner surface and an outer surface formed into a closed end and an open end, the bag being having an interior volume sufficient to enclose the accordion head and at least a portion of the elongated handle; and a securing ring moveable between an expanded condition and a contracted condition to expand around and contract against the circular rim and secure the flexible plastic bag to the circular rim.

2. A disposable accordion toilet plunger cover assembly as claimed in claim 1 wherein the securing ring further comprising:

a sealing surface for engaging a toilet drain;

an opposing inner shoulder for receiving the circular rim thereagainst; and an upright element moveable between an expanded condition and a contracted condition to expand around and contract against the circular rim.

3. An accordion toilet plunger with disposable cover assembly, comprising:

an elongated handle;

an accordion head attached to one end of the handle, the accordion head having an open end defined by a circular rim opposite the elongated handle and a plurality of pleats formed between the elongated handle and the open end, the plurality of pleats defining an interior volume;

a flexible plastic bag having an inner surface and an outer surface formed into a closed end and an open end, the bag having an interior volume enclosing the accordion head and at least a portion of the elongated handle, a portion of the closed end of the flexible plastic bag received within the interior volume of the accordion head; and a securing ring moveable between an expanded condition and a contracted condition to expand around and contract against the circular rim and secure the flexible plastic bag to the circular rim.

4. An accordion toilet plunger with disposable cover assembly as claimed in claim 3 wherein the securing ring further comprising:

a sealing surface engaging a toilet drain;

an opposing inner shoulder receiving the circular rim thereagainst; and an upright element moveable between an expanded condition and a contracted condition to expand around and contract against the circular rim.

5. An accordion toilet plunger with disposable cover assembly as claimed in claim 4 wherein a volume defined by the portion of flexible plastic bag inserted into the interior volume is similar to a volume of the interior volume, and will compress with the compression of the plurality of pleats.

6. A method of using a disposable toilet plunger cover assembly with an accordion toilet plunger comprising the steps of:

providing an elongated handle and an accordion head attached to one end of the handle, the accordion head having an open end defined by a circular rim opposite the elongated handle and a plurality of pleats formed between the elongated handle and the open end, the plurality of pleats defining an interior volume;

providing a flexible plastic bag having an inner surface and an outer surface formed into a closed end and an open end, the bag having an interior volume, providing a securing ring moveable between an expanded condition and a contracted condition;

positioning a portion of the closed end of the flexible plastic bag through the circular rim into the interior volume of the accordion head;

extending the open end of the flexible plastic bag over the circular rim to enclose the accordion head and at least a portion of the elongated handle; and coupling the securing ring to the circular rim with the flexible plastic bag captured therebetween.

7. A method of using a disposable toilet plunger cover assembly with an accordion toilet plunger as claimed in claim 6, wherein the step of coupling the securing ring includes expanding the securing ring to be received around the circular rim and allowing the securing ring to contract against the circular rim, and securing the flexible plastic bag to the circular rim.

8. A method of using a disposable toilet plunger cover assembly with an accordion toilet plunger as claimed in claim 6 wherein the step of positioning a portion of the closed end of the flexible plastic bag through the circular rim into the interior volume of the accordion head includes a volume defined by the portion of flexible plastic bag inserted into the interior volume being similar to a volume of the interior volume which will compress with the compression of the plurality of pleats.

* * * * *